US006184629B1

(12) United States Patent
Won

(10) Patent No.: US 6,184,629 B1
(45) Date of Patent: Feb. 6, 2001

(54) KNITTING STRUCTURE OF POWER-SUPPLY WIRES IN ORNAMENTAL LAMP

(76) Inventor: Jen-Chen Won, P.O. Box 96-405, Taipei 106 (TW)

( * ) Notice: Under 35 U.S.C. 154(b), the term of this patent shall be extended for 0 days.

(21) Appl. No.: 09/533,509

(22) Filed: Mar. 23, 2000

(51) Int. Cl.[7] ..... F21P 1/02
(52) U.S. Cl. ..... 315/185 S; 362/123; 362/806
(58) Field of Search ..... 315/185 R, 185 S; 362/123, 122, 806, 227, 252

(56) References Cited

U.S. PATENT DOCUMENTS 4,870,547 * 9/1989 Crucefix ..... 362/123
5,775,802 7/1998 Kuo ..... 362/396

* cited by examiner

*Primary Examiner*—David Vu

(57) ABSTRACT

A knitting structure of power-supply wires in ornamental lamp, which mainly comprises several lamp strings in parallel to form into a large net-shaped ornamental lamp; the sockets of every lamp string are connected, in series, with a plurality of short power-supply wires to form into a single-wire lamp string; the short power-supply wires in each single-wire lamp string are twisted together with a knitting cord from the first socket to the last socket thereof so as to form into a lamp string assembly having a better tensile strength.

3 Claims, 11 Drawing Sheets

KNITTING STRUCTURE OF POWER-SUPPLY WIRES IN ORNAMENTAL LAMP

BACKGROUND OF THE INVENTION

1. Field of the Invention

This invention relates to a Christmas lamp, and particularly to a knitting structure of power-supply wires in ornamental lamp.

2. Description of the Prior Art

In the conventional lamp strings for Christmas ornament, the ornament usually comprises an independent power-supply wire connected, in series, with a plurality of sockets, and the last socket on the tail end thereof is connected with an independent wire. Two independent power-supply wires are then twisted together to form into a lamp string; all the sockets in one lamp string are mounted with bulbs respectively so as to form into a lamp string for Christmas ornament.

The conventional lamp string for Christmas ornament can also be mounted on a wall surface or a wide plane; as shown in FIG. 10, a plurality of lamp strings are connected with and under a main power-supply cable. The two independent power-supply wires of every lamp string are not twisted; the sockets of two adjacent lamp strings are arranged in intersection shape. The independent power-supply wire of one lamp string and the sockets of another lamp string are held together by means of a clasper so as to knit all the lamps into a network of ornament; the aforesaid prior art is published in U.S. Pat. No. 5,775,802; the independent power-supply wires of the prior art are hung under the main power-supply cable; the number of strands of the power-supply wire and the diameter thereof have been increased properly so as to withstand pulling unintentionally.

In another conventional network of ornamental lamp strings as shown in FIG. 11, it comprises a plurality of twisted lamp strings to be connected with a main power-supply cable; all the lamp strings are hung under the main power-supply, and the sockets of two adjacent lamp strings are arranged in intersection shape, and then the sockets of one lamp string and the power-supply wire of an adjacent lamp string are fastened together by means of claspers so as to form into a network of ornamental lamp strings; finally, a socket on the tail end of every two adjacent lamp strings will be unable to hold stably as a result of the intersection arrangement, and that socket is subject to swaying in the wind.

SUMMARY OF THE INVENTION

The prime object of the present invention is to provide a knitting structure of power-supply wires in ornamental lamp, in which every lamp string includes a plurality of sockets connected in series by means of a plurality of short power-supply wires, and then the lamp string is twisted together with a knitting cord without copper wire to form into an elongate lamp string; a plurality of lamp strings can be knitted into an ornamental lamp as desired so as to save the use of copper wire which is usually used as power-supply wire.

Another object of the present invention is to provide a knitting structure of power-supply wires in ornamental lamp, in which a loop type of ornamental lamp is knitted by using a plurality of short power-supply wires to connect in series, from the first socket to the second socket respectively and so on, almost simultaneously a knitting cord without copper wire is used to twist the lamp string together to form into a lamp string assembly; then, the last socket thereof is connected with a main power-supply wire and a plug so as to provide a lamp string having a better tensile strength, of which the knitting method is the same as that of the conventional lamp string, and it can be knitted simply and conveniently.

Still another object of the present invention is to provide a knitting structure of power-supply wires in ornamental lamp, in which the short power-supply wires connected in series between every two sockets form into a single-wire lamp string, which is then twisted together with a knitting cord to form into a lamp string assembly; since the lamp string assembly includes a knitting cord without copper wire, it will have a better tensile strength.

A further object of the present invention is to provide a knitting structure of power-supply wires in ornamental lamp, in which the lamp strings twisted with the knitting cords are separated and hung down; a knitting cord without copper wire is used to connect two adjacent lamp strings with a cross-connecting method so as to form into a lamp net; then, several lamp strings may be knitted in parallel to form into a large ornamental lamp net.

A still further object of the present invention is to provide a knitting structure of power-supply wires in ornamental lamp, in which every two adjacent sockets in each lamp string are connected in series with a short power-supply wire, and then a knitting cord without copper wire is used to twist the lamp string to form into an elongate lamp string; an independent power-supply wire is connected with the last socket of the lamp string so as to form into an elongate lamp string. Before the length of the independent power-supply wire is determined, the lamp string can be used to knit into a large lamp string, such as an ornamental lamp net or an ornamental screen light.

DETAILED DESCRIPTION OF THE PREFERRED EMBODIMENT

Figure 1:
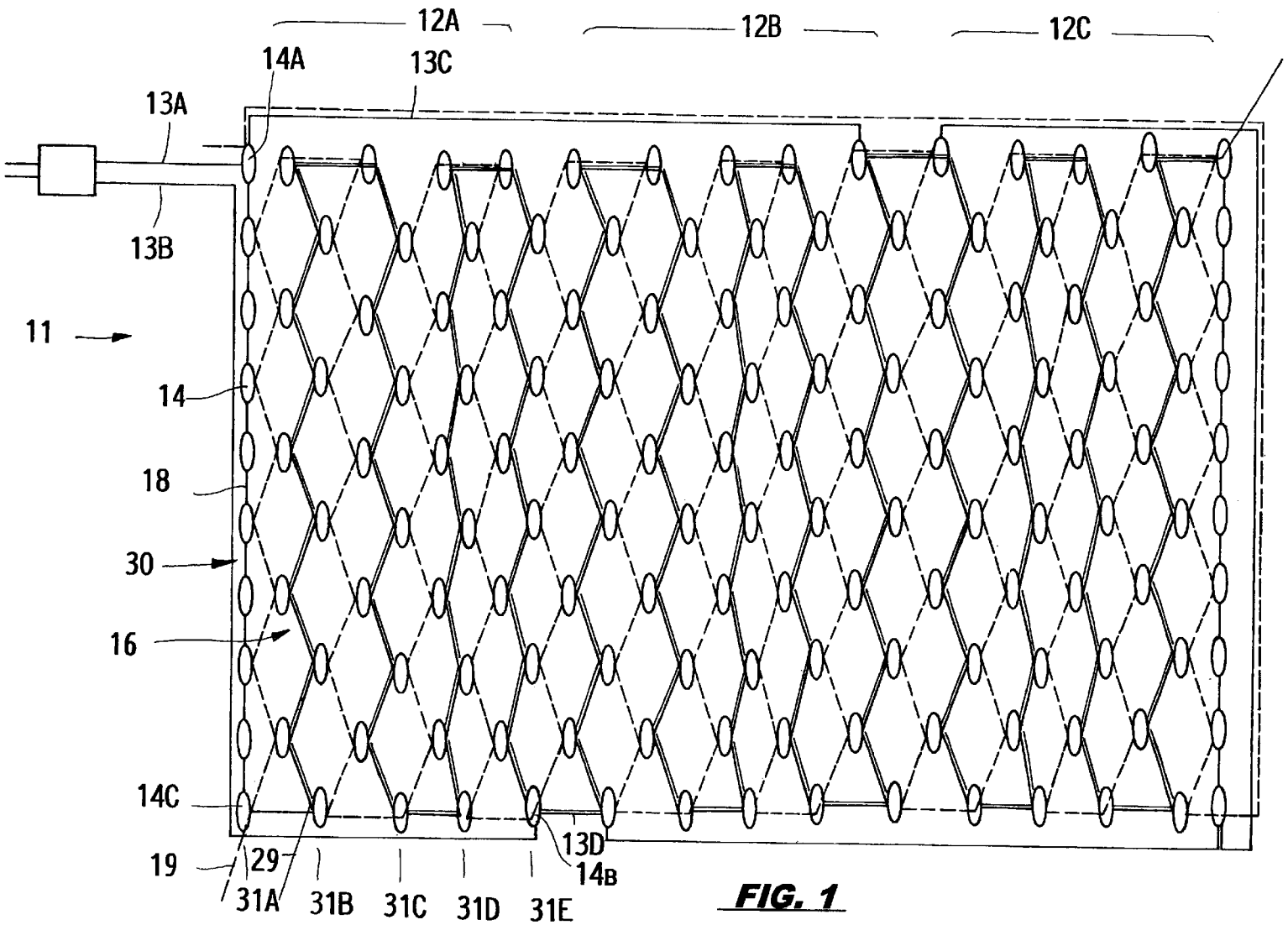
FIG. 1 is a plan view of the present invention, showing the first embodiment of a lamp net thereof.

Referring to FIGS. 1, 3, 5 to 7, the present invention relates to a knitting structure of power-supply wires in ornamental lamp 11, which comprises several lamp strings 12A, 12B and 12C; each lamp string 12 includes two power-supply wires 13 connected with a plug; for instance, the first lamp string 12A has a main power-supply wire 13A with a copper terminal to be plugged into a plug groove of the first socket 14A; simultaneously, a main power-supply wire 13C extends out of the socket is connected with the second lamp string 12B, and then another main power-supply wire 13B with a copper terminal is plugged into a plug groove of the last socket 14B of the first lamp string 12A so as to provide the first lamp string 12A with a power-supply; simultaneously, another main power-supply wire 13D extends out of the plug groove to connect with the second lamp string 12B. Each lamp string 12 of the ornamental lamp 11 is assembled with a plurality of sockets 14 connected one another in series by using a plurality of short power-supply wires 18 so as to form into a single-wire lamp string 30, in which the knitting cord 29 without copper wire is twisted together with the lamp string for increasing the tensile strength of the lamp string 12; then, a knitting cord 19 without copper wire and a fastening ring 17 are used for knitting a plurality of lamp strings 12 into a lamp net as an ornament.

Figure 3:
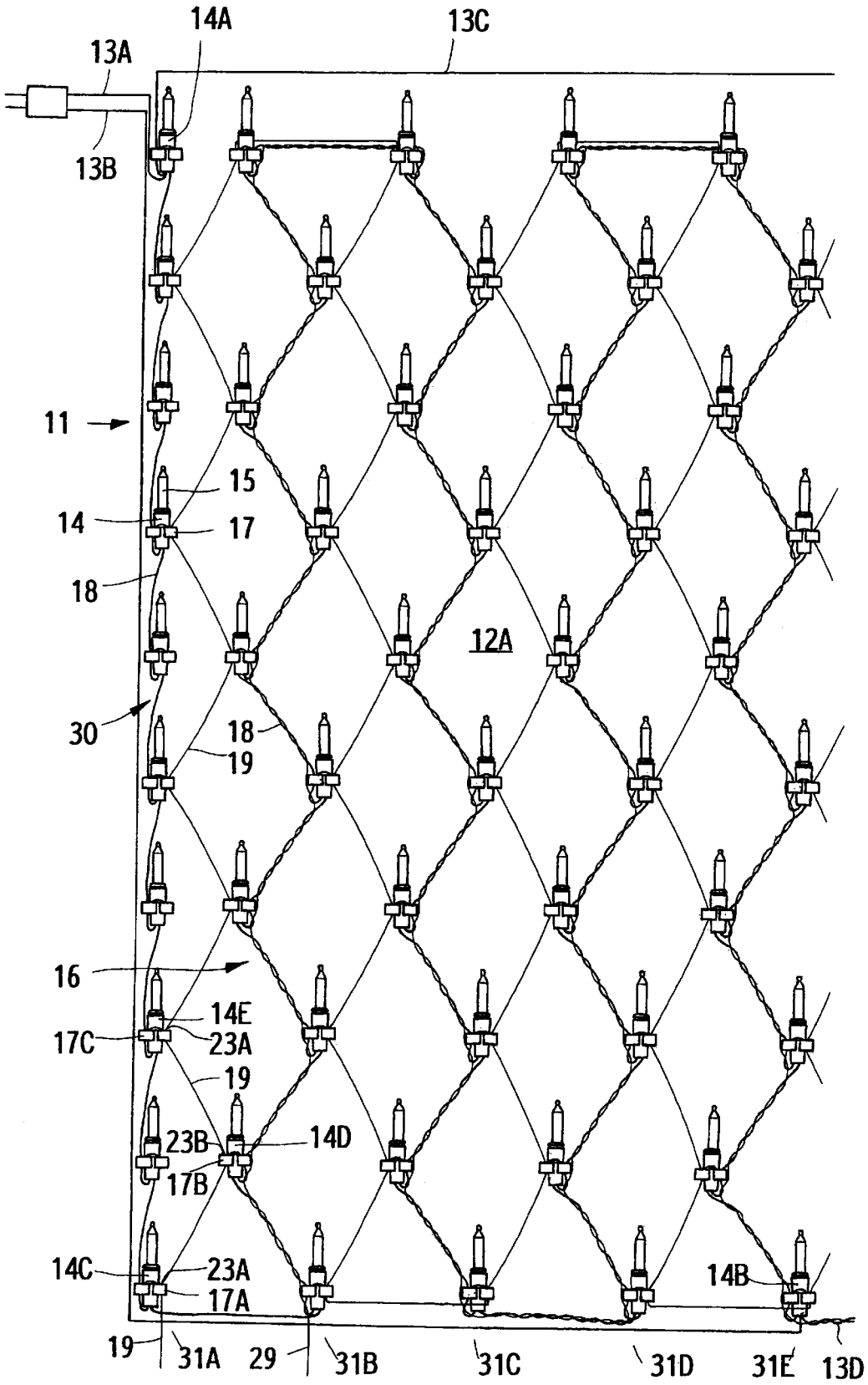
FIG. 3 is a plan view of the present invention, showing a lamp string in a lamp net of the first embodiment.
Figure 5:
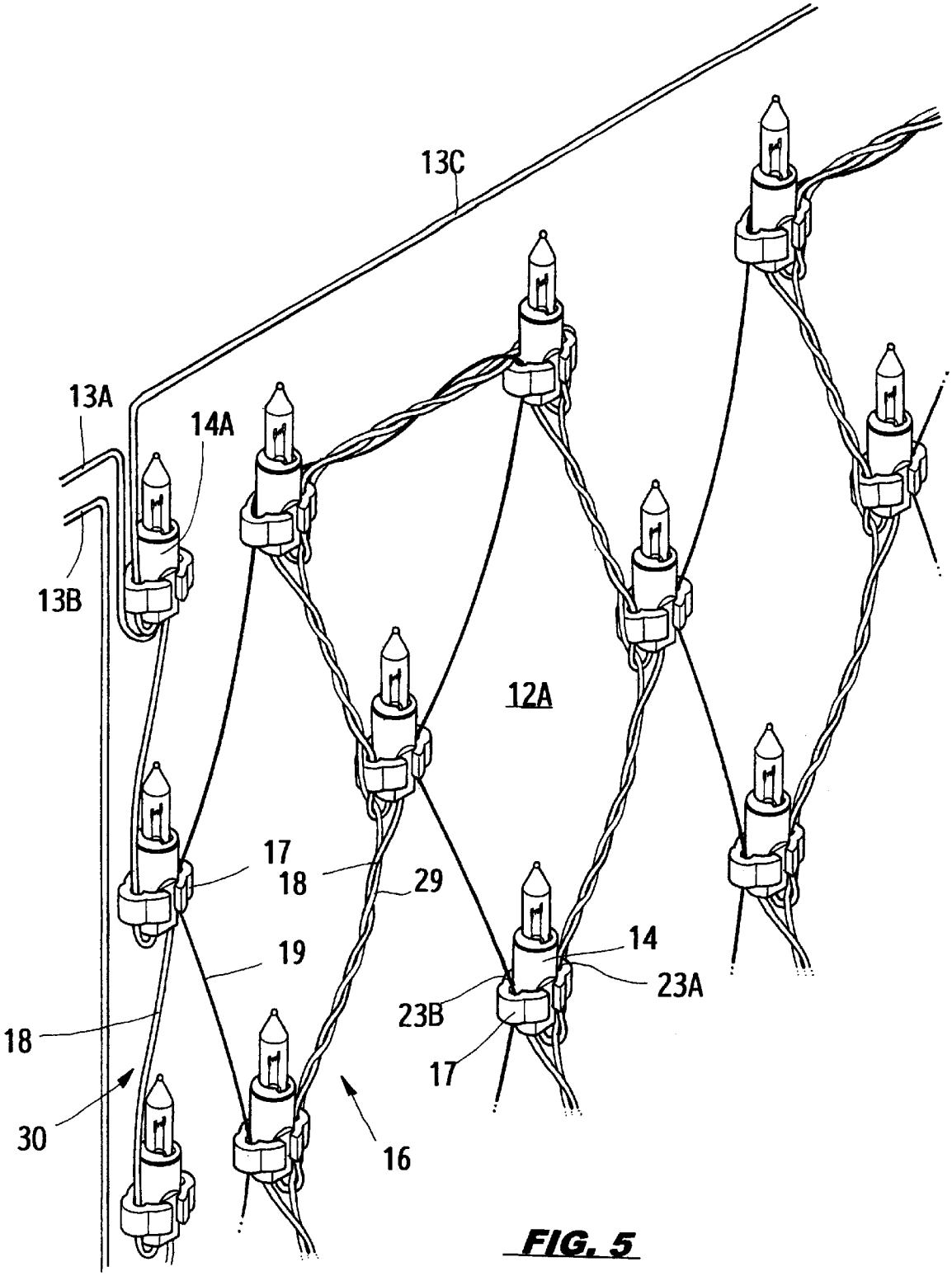
FIG. 5 is a perspective view of the present invention, showing the knitting relation between the power-supply wires and the knitting cord.
Figure 6:
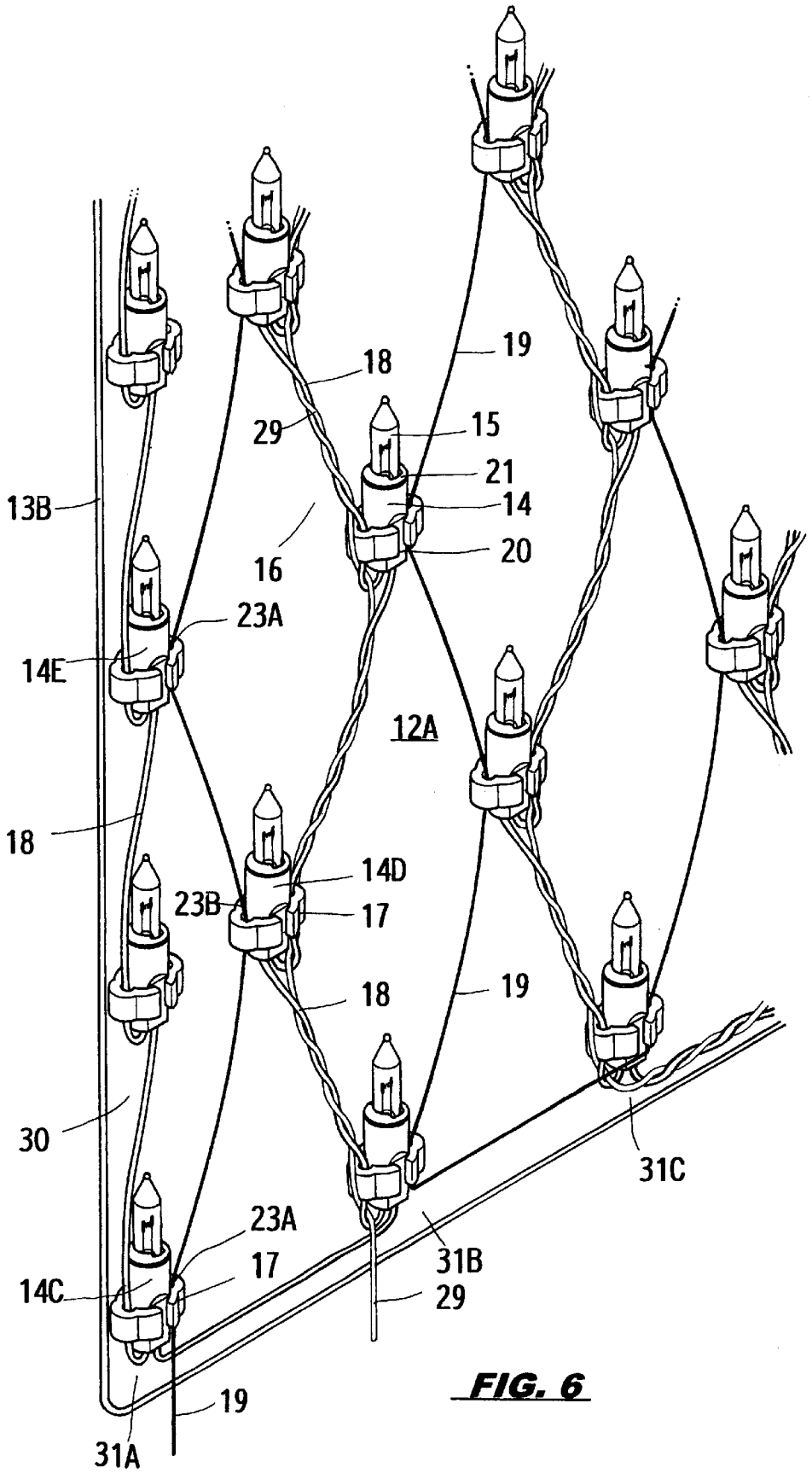
FIG. 6 is a perspective view of the present invention, showing the twisting and knitting relation between the two knitting cords and the sockets.

As shown in FIGS. 3, 5 and 6, the first lamp string 12A is formed by means of sockets 14 and a plurality of short power-supply wires 18, and each short power-supply wire is connected with two sockets 14 so as to knit into a single-wire lamp string 30; each socket 14 in the lamp string 30 is substantially a conventional socket. The lower part of the socket 14 is furnished with a rectangular base 20, which is mounted with a fastening ring 17; one side of the fastening ring has a clamp groove for retaining a short power-supply wire 18 or a knitting cord 29. The lower end of the socket 14 has a plug hole for receiving a copper terminal of the power-supply wire 18, and then the copper terminal will be plugged into the plug groove before a bulb base 21 having a bulb 15 to be plugged therein. A plurality of short power-supply wires 18 and a plurality of sockets 14 are connected together in series to form into a single-wire lamp string 30, of which the first socket 14A and the last socket 14B are connected with two main power-supply wires 13A and 13B respectively so as to form into an independent lamp string 12A.

Before the ornamental lamp 11 being completed, the single-wire lamp string 30 of every lamp string 12 must be furnished with a plurality of short power-supply wires 18 and a plurality of sockets 14 to be connected together in series; a given number of sockets 14 must be furnished for an ornamental lamp 11. As shown in FIG. 1, the ornamental lamp 11 requires 150 sockets 14, which are connected in wires with a plurality of short power-supply wires 18 so as to form into a long and single-wire lamp string 30. In order to increase the tensile strength of the single-wire lamp string 30, a knitting cord 29 without copper wire is twisted together with the short power-supply wire 18 of the single-wire lamp string 30; since the lamp string assembly 16 with a knitting cord 29 could have additional tensile strength, the power-supply wire of the ornamental lamp 11 will also have a better tensile strength.

The knitting cord 29 without copper wire is made of plastic cord; as shown in FIGS. 1, 3, 5, to 7, the knitting cord 29 is twisted together with the single-wire lamp string 30 from the eleventh socket 14 to the last 10 sockets thereof so as to form into a lamp string assembly 16. During twisting the knitting cord 29 and the single-wire lamp string 30, every socket 14 is not mounted with a bulb 15 so as to facilitate a twisting machine to twist the same together to form into a lamp string assembly 16. When the knitting cord 29 and the single-wire lamp string 30 are twisting together, the main power-supply wire of every lamp string 12 has a plug terminal, which is used for connecting the short power-supply wire 18; as soon as the single-wire lamp string 30 and the knitting cord 29 are twisted into a lamp string assembly 16, the main power-supply wire 13 will be connected with the socket 14 to form into a lamp string 12.

Figure 2:
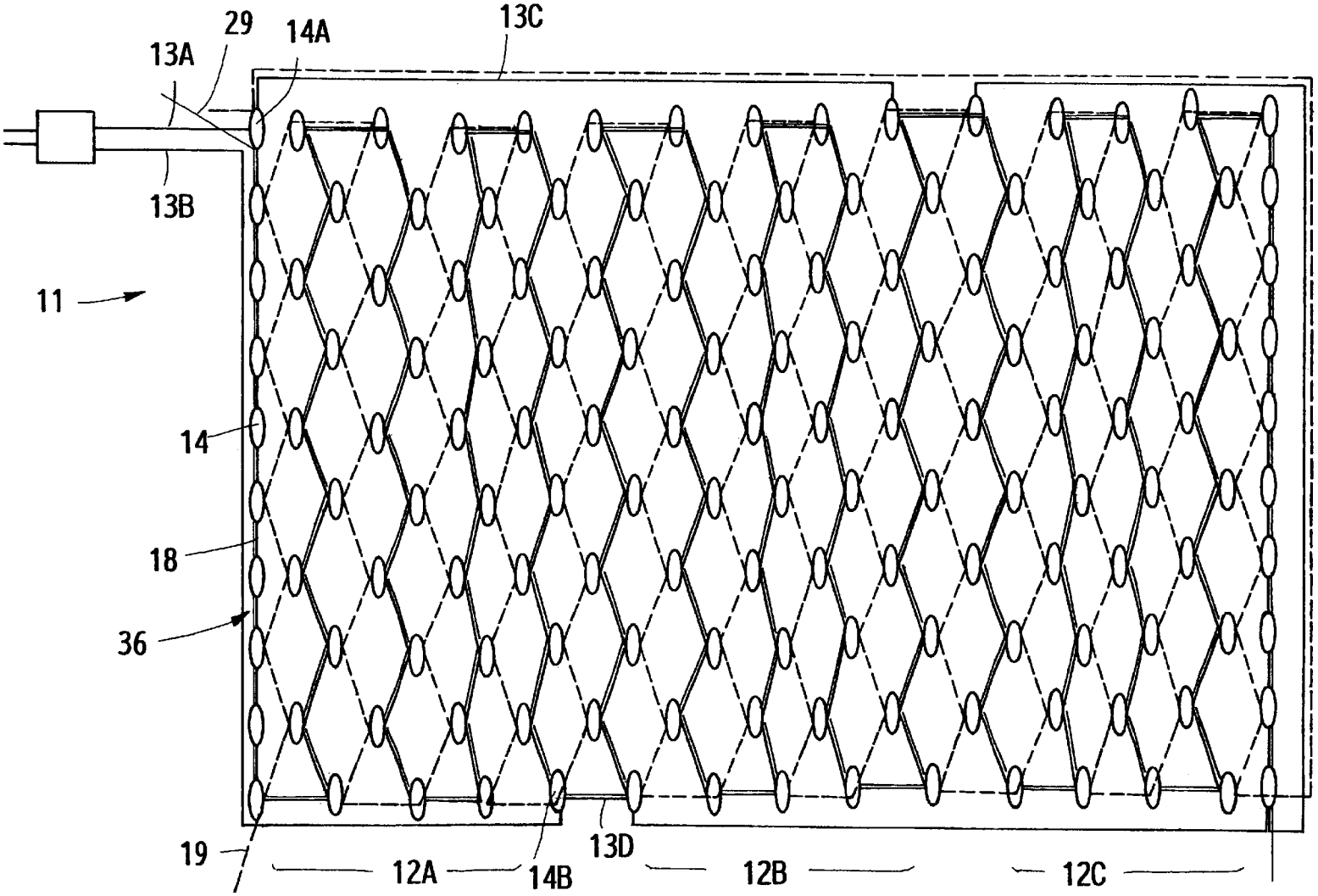
FIG. 2 is a plan view of the present invention, showing the second embodiment of a lamp net thereof.
Figure 4:
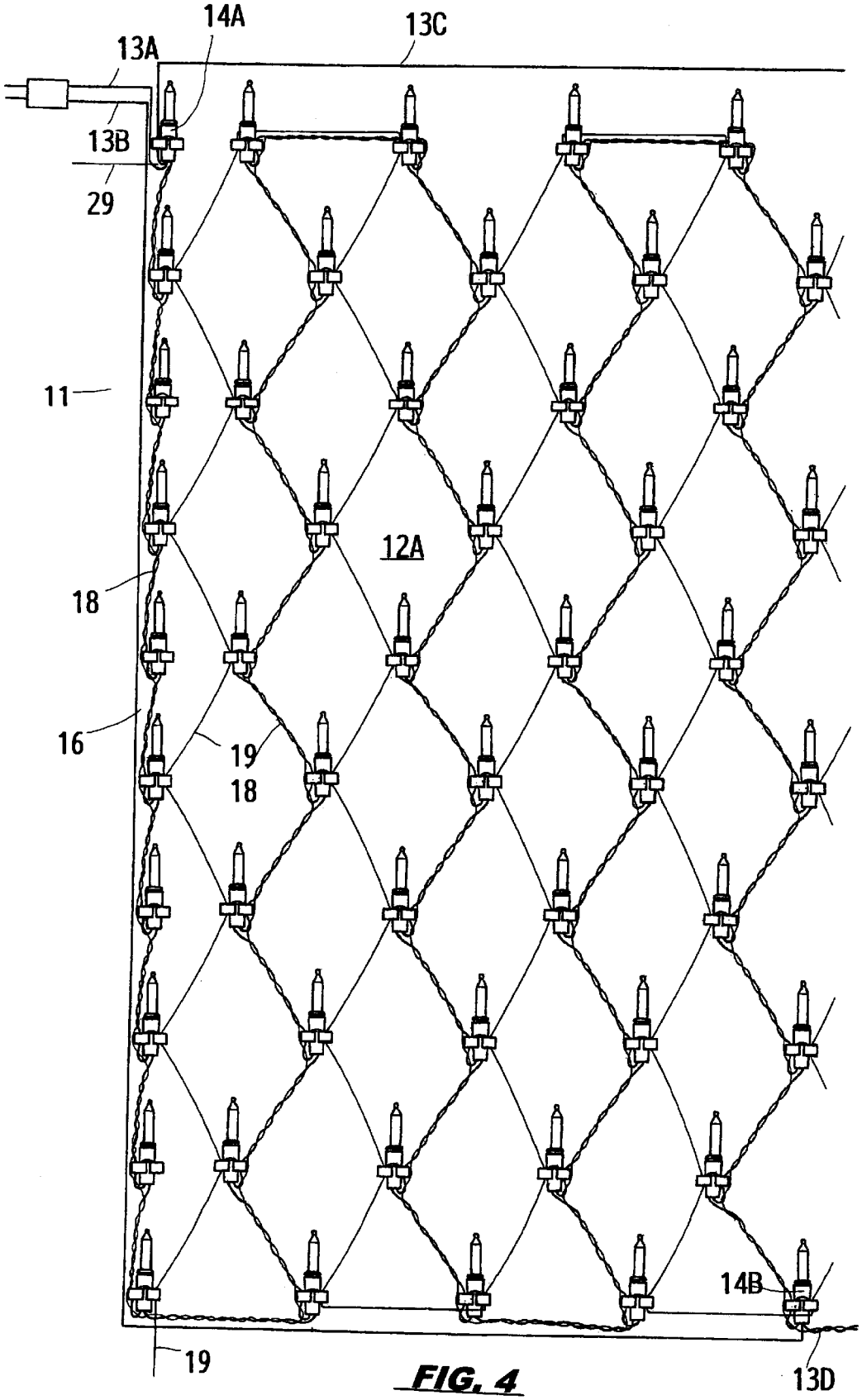
FIG. 4 is a plan view of the present invention, showing a lamp string in a lamp net of the second embodiment.

As shown in FIGS. 2 and 4, the knitting cord 29 is started to twist with the single-wire lamp string 30 from the first socket 14A until the last socket 14B of the last lamp string so as to complete a lamp string assembly 16.

In a lamp string 12, every two sockets 14 are connected with a short power-supply wire 18 before being twisted with the knitting cord 29 without copper wire; then, each lamp string 12 can withstand hard pull so as to prevent the short power-supply wire 18 between two sockets 14 from being pulled apart.

As shown in FIGS. 1, 3 and 6, the single-wire lamp string 30 is done by means of a plurality of short power-supply wires 18 connected, in series, with a plurality of sockets 14; to knit a lamp net, the knitting cord 29 is connected first with the eleventh socket 14 to twist together with the single-wire lamp string 30 until the last ten (10) sockets 14 of the ornamental lamp 11; the first socket to the tenth socket are connected together in series to form into the first lamp assembly 31A of a lamp net. The eleventh socket to $20^{th}$ socket are connected together to form into the second lamp assembly 31B, while the $21^{st}$ socket to the $30^{th}$ socket are connected together to form into the third lamp assembly 31C, and so on. The last another knitting cord 19 is started to mount on the last socket 14C through a clamp groove 23A in the fastening ring 17 on one side of the socket 14C; then, the knitting cord 19 is pulled, at a diagonal, towards the second socket 14D of the second lamp assembly 31B, and then is mounted in a clamp groove 23B on one side of the socket 14D; then, the knitting cord 19 is pulled, at a diagonal, towards the third socket 14E of the first lamp assembly 31A, and is mounted in a clamp groove 23A on one side of the third socket 14E; likewise, the first and the second lamp assemblies 31A and 31B can also be done with the aforesaid method. The knitting cord 19 can be pulled from the second lamp assembly 31B to the upper part of the third lamp assembly 31C before knitting the sockets respectively in the second and the third lamp assemblies 31B and 31C so as to complete a lamp net. The knitting cord 19 without copper wire is then pulled back to knit together with the main power-supply wires 13 of all the lamp strings 12 so as to form into a lamp net as an ornament. The knitting cords 19 and 29 can surely increase the tensile strength of the single-wire lamp string 30, and the inner and outer structure of the lamp net.

Figure 7:
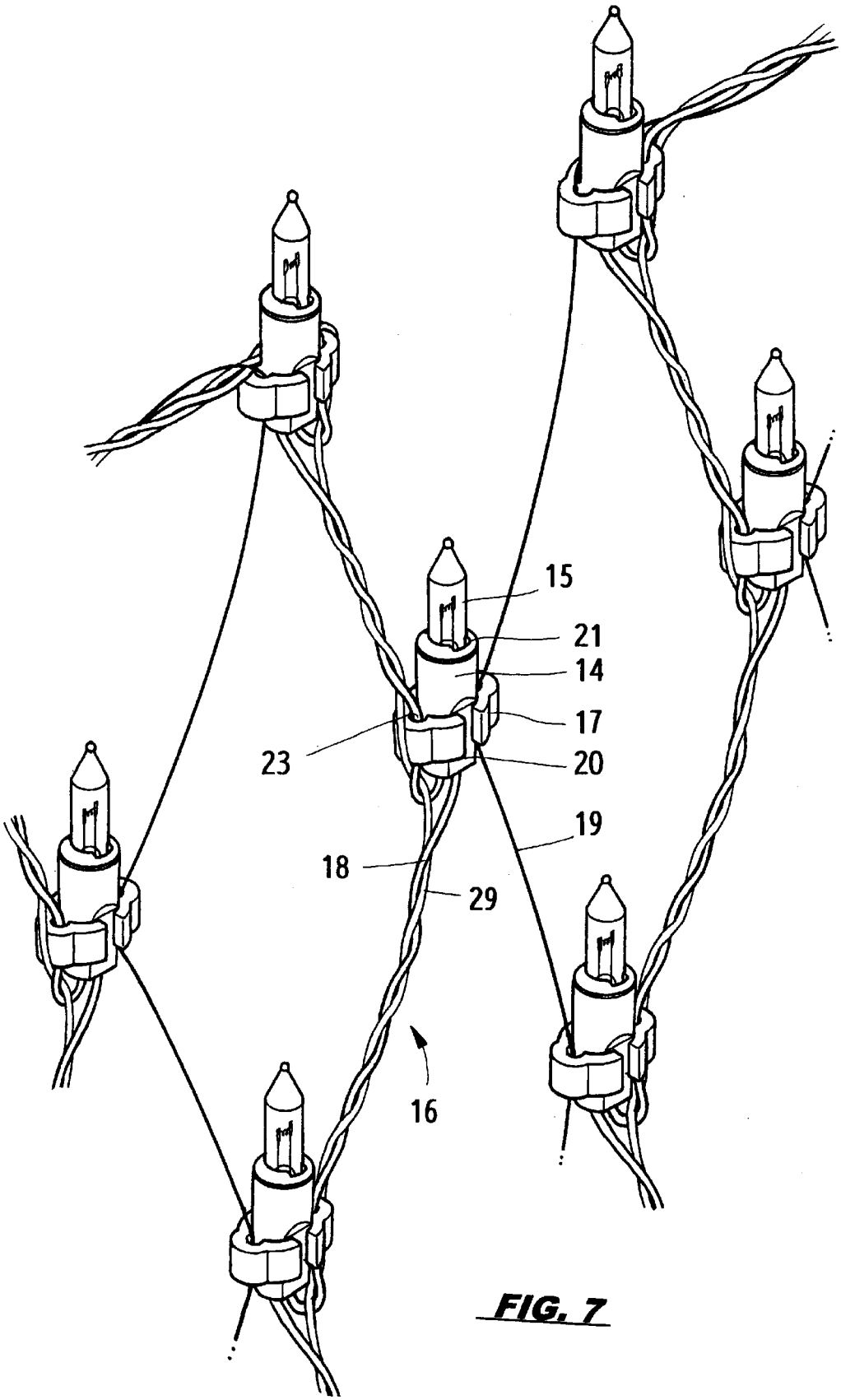
FIG. 7 is a perspective view of the present invention, showing the knitting relation between the sockets and the knitting cord by using a fastening ring.

Both knitting cords 19 and 29 are made of plastics without copper wire; as shown in FIGS. 5 to 7, the knitting cord 19 is shown with a single cord.

The lamp net includes several lamp strings 12, of which each includes:

A short power-supply wire 18 is connected between two sockets 14, and a plurality of short power-supply wires are used for connecting a plurality of sockets 14 respectively so as to form into a single-wire lamp string 30. The sockets 14 on both ends of every single-wire lamp string 30 are connected with the main power-supply wire 13 and a plug respectively.

The knitting cord 29 and a single-wire lamp string 30 are twisted together so as to form into a lamp string assembly 16 having considerable tensile strength.

A fastening ring 17 selected is to be mounted on the rectangular base 20 of the socket 14; both sides of the fastening ring 17 are furnished with two clamp grooves 23 for fastening the knitting cord 19 and the lamp string assembly 16 in place.

The knitting cord 19 will be connected with the socket 14 as soon as the fastening ring 17 is mounted on the rectangular base 20 of the socket 14, and then a lamp net is completed.

Figure 8:
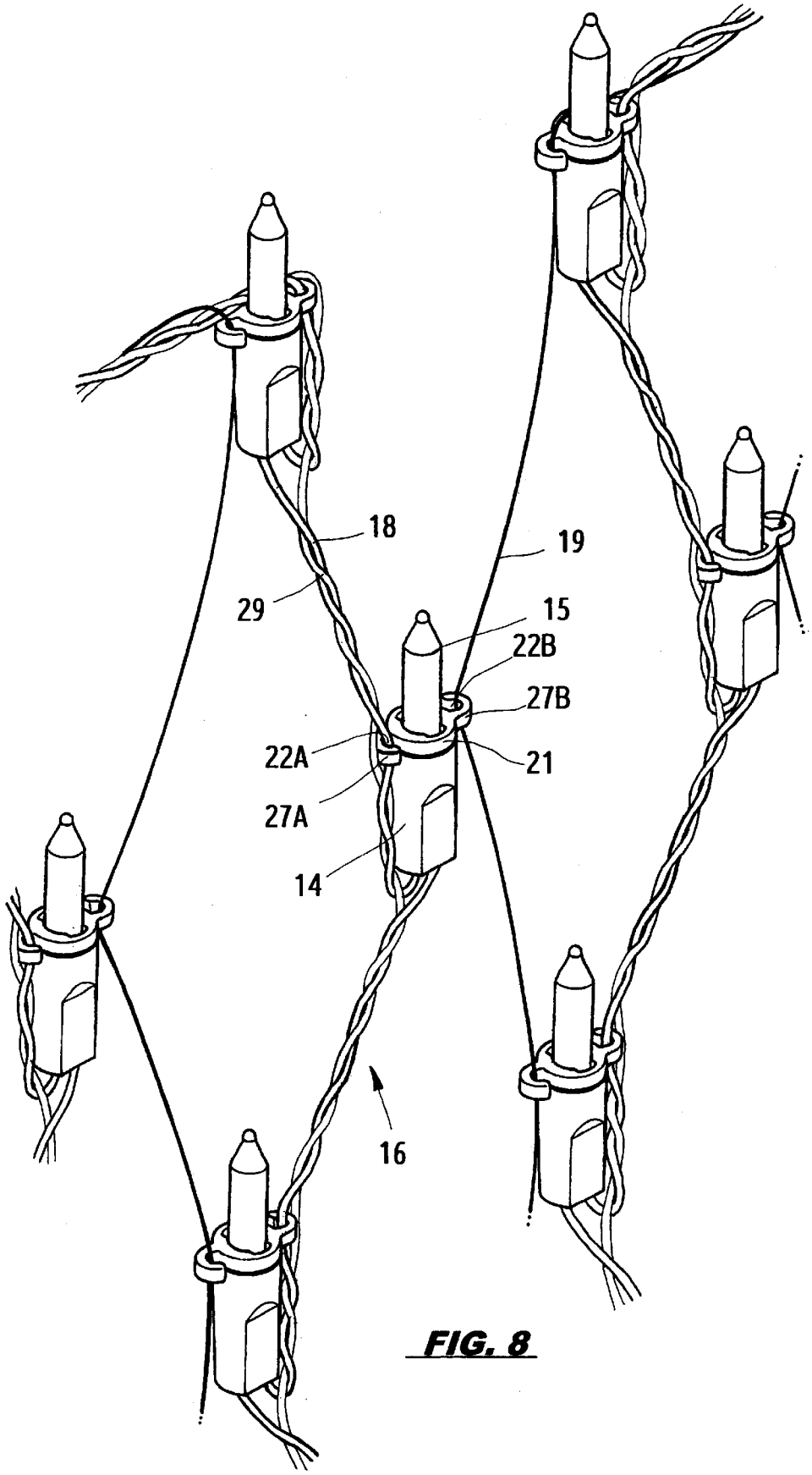
FIG. 8 is a perspective view of the present invention, showing the knitting relation between the socket and the knitting cord by using a clamp groove beside the socket.

As shown in FIG. 8, the socket 14 of the present invention is substantially a conventional socket to be plugged in the bulb base 21 of the socket 14, of which both sides are furnished with two symmetrical retaining rings 27 respectively; one retaining ring 27A with a clamp groove 22A is used for holding a short power-supply wire 18 or a knitting cod 29, while the other retaining ring 278 is used for holding a knitting cord 19 in the clamp groove 22B so as to have a single-wire lamp string 30 mounted with a plurality of sockets 14 twisted together with the knitting cord 29, and to form into a lamp string assembly 16. When the bulb base 21 is plugged in the socket 14, the retaining ring 27, the lamp string assembly 16 and the knitting cord 29 will be knitted together to form into an ornamental lamp net.

Figure 9:
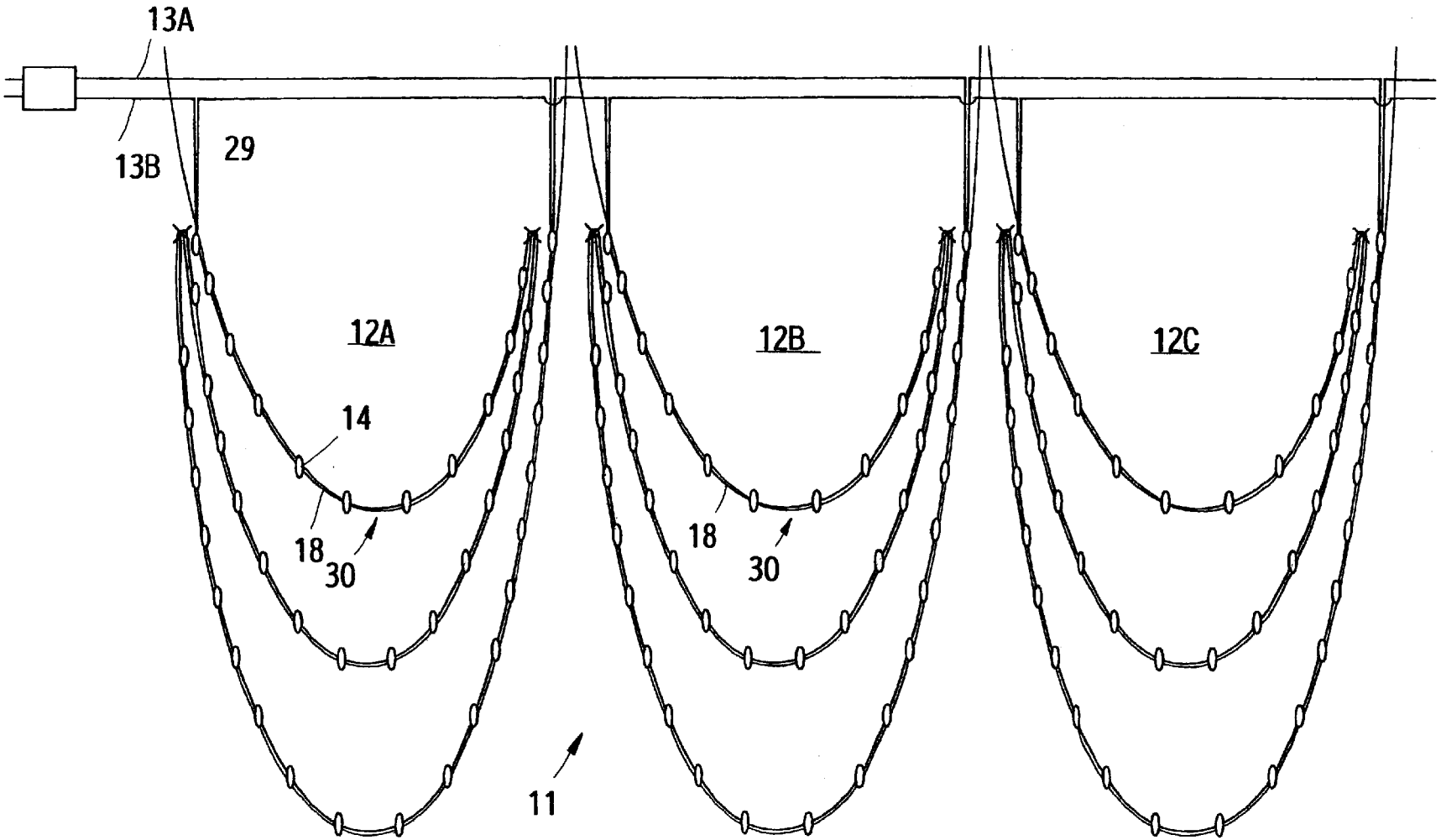
FIG. 9 is a plan view of the present invention, showing an embodiment used as a curtain light.
Figure 10:
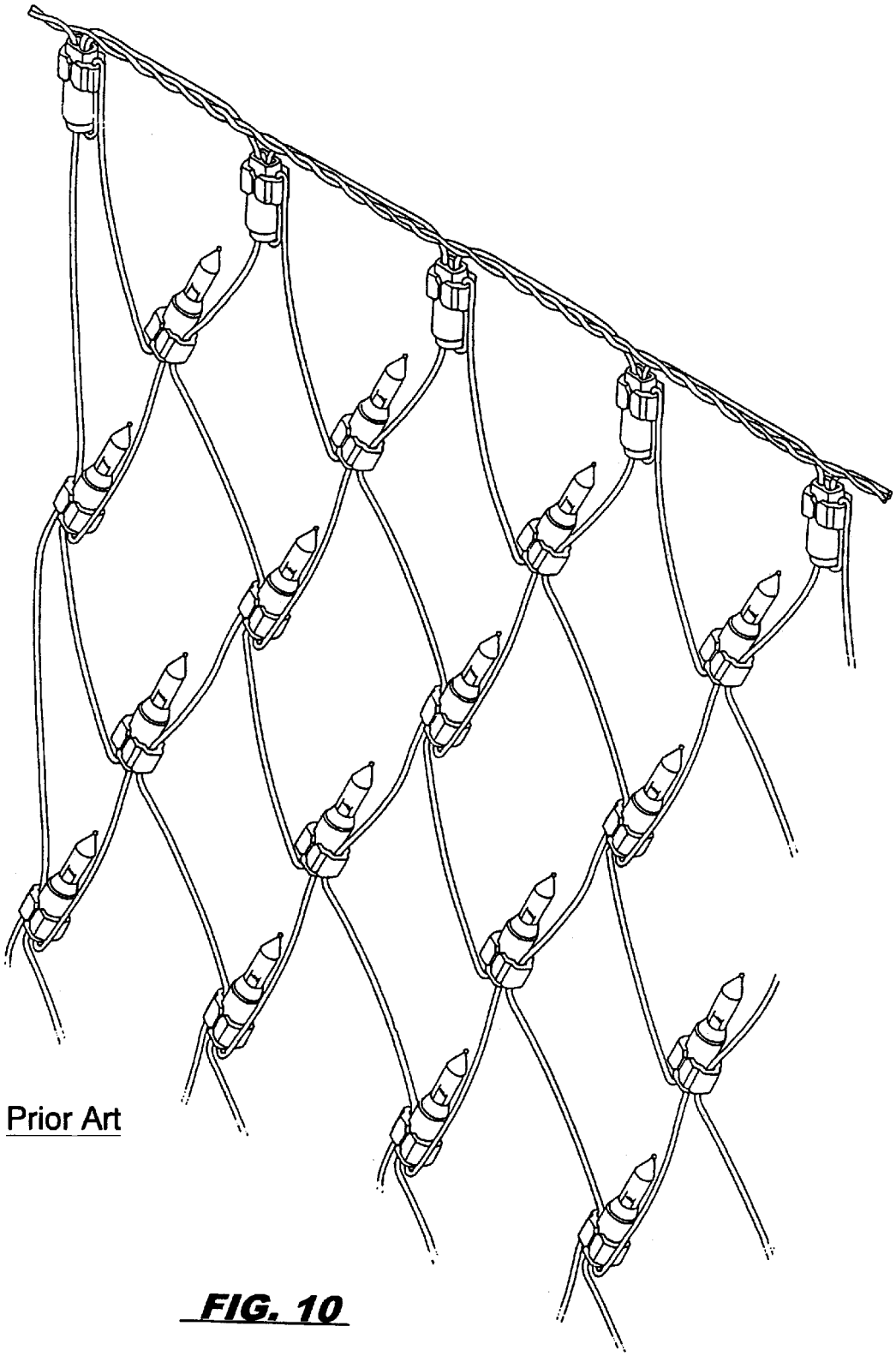
FIG. 10 is a plan view of a conventional lamp net, showing a fragmental knitting structure thereof.
Figure 11:
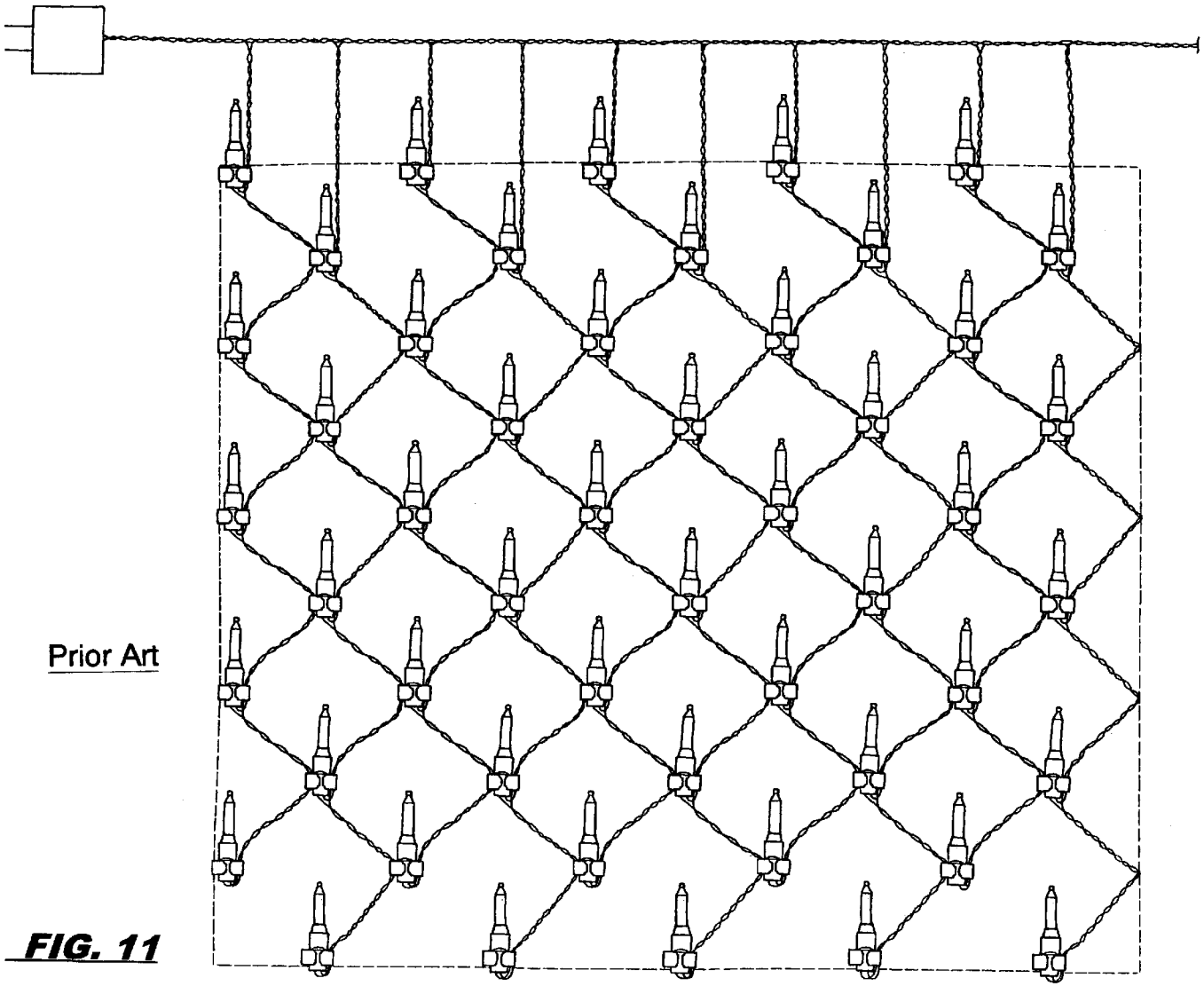
Prior Art FIG. 11
FIG. 11 is a plan view of a conventional lamp net, showing a fragmental knitting structure thereof.

Referring to FIG. 9, it shows an embodiment of an ornamental screen light; such an ornamental lamp 11 includes two main power-supply wires 13 connected with a plurality of lamp strings 12. The sockets 14 in every lamp string, such as 12A, 12B and 12C, are connected in series with a plurality of short power-supply wires 18 respectively in a regular sequence to form into a single-wire lamp string 30; every single-wire lamp string 30 in lamp strings 12A, 12B and 12C is twisted together with a knitting cord 29 without copper wire. Both ends of every lamp string, such as 12A, 12B and 12C, are connected with two main power-supply wires 13, which is then connected with a plug. Each of the lamp strings 12A, 12B and 12C has its reverse points (shown with "X"), and it is bundled up in place to form into lamp strings 12A, 12B and 12C, which are to be hung in place by means of the two ends of the knitting cord 29 to connect with a hook or ring so as to have the ornamental screen light hung in place. The knitting cord 29 without copper wire used to hang the ornamental lamp 11 has an advantage of preventing the power-supply wires form being pulled off as a result of the weight of the lamp strings 12.

According the description of the aforesaid embodiment, the knitting structure of the power-supply wires for the ornamental lamp has been disclosed completely, and it includes a plurality of short power-supply wires 18 connected in series with a plurality of sockets 14 to form into a single-wire lamp string 30; then, single-wire lamp strings is twisted with a knitting cord 29 without copper wire to form into a lamp string assembly 16. According to the knitting method of an ornamental lamp 11, the lamp string assemblies 16 are knitted together with a knitting cord 19 in a cross-connecting method to form into a net-shaped ornamental lamp 11; since the knitting cord 29 can provide a given tensile strength, it can also increase the tensile strength of the power-supply wires of the ornamental lamp 11.

What is claimed is:

1. A knitting structure of power-supply wires in ornamental lamp comprising mainly several lamp strings connected in parallel to knit into a large net-shaped ornamental lamp, and each said lamp string including:

a plurality of short power-supply wires and each said wire connected between two sockets so as to form into a single-wire lamp string, of which the first and the last sockets connected with two main power-supply wires respectively and a plug;

a knitting cord without copper wire twisted with, from the first socket, said short power-supply wires of said single-wire lamp string so as to form into a lamp string assembly having a better tensile strength; both ends of said lamp string left with a suitable length of knitting cords;

a fastening ring mounted on a rectangular base of said socket, and both sides of said fastening ring furnished with clamp grooves for receiving and positioning said knitting cords respectively;

said knitting cord without copper wire mounted between said lamp string assemblies, and twisted from the first socket of a lamp string, and mounted via clamp grooves between two diagonal sockets of two adjacent lamp string assemblies until the last socket of said lamp string assembly.

2. A knitting structure of power-supply wires in ornamental lamp as claimed in claim 1, wherein knitting and positioning structure are done by means of two symmetrical retaining rings on both sides of said socket, and said retaining rings used for retaining said short power-supply wires or knitting cord of said lamp string assembly.

3. A knitting structure of power-supply wires in ornamental lamp comprising several lamp strings connected together in parallel to form into a large ornamental screen light, and each said lamp string including:

a short power-supply wire connected between two sockets, and a plurality of said short power-supply wires connected between every two sockets respectively to form into a single-wire lamp string, of which the first socket and the last socket connected with two main power-supply wires respectively and a plug;

a knitting cord without copper wire twisted with said first socket of said single-wire lamp string so as to form into a lamp string assembly with a better tensile strength; both ends of said lamp string assembly left a suitable length of knitting cord;

a reverse point of said lamp string being bundled up as a fastening point; said knitting cords left on both ends of said lamp string assembly to be connected with a hook or a ring.

* * * * *